United States Patent [19]

Mellors et al.

[11] Patent Number: 4,999,237

[45] Date of Patent: Mar. 12, 1991

[54] CUSHION INSOLE/INSOCK MATERIAL

[75] Inventors: Harry Mellors, Leicester; Susan G. Johnson, Desford, both of England

[73] Assignee: British United Shoe Machinery Ltd., Leicester, England

[21] Appl. No.: 567,279

[22] Filed: Aug. 14, 1990

[30] Foreign Application Priority Data

Aug. 25, 1989 [GB] United Kingdom ..... 8919389

[51] Int. Cl.[5] ..... D04H 1/08

[52] U.S. Cl. ..... 428/280; 36/43; 428/288; 428/289; 428/290; 428/297; 428/300; 428/373; 428/284; 428/423.1

[58] Field of Search ..... 428/280, 289, 287, 297, 428/288, 300, 373, 290, 423.1; 36/43

[56] References Cited

U.S. PATENT DOCUMENTS

| | | | |
|---|---|---|---|
| 3,708,332 | 1/1973 | Closson | 428/289 |
| 4,296,054 | 10/1981 | Takagi | 428/300 |
| 4,461,099 | 7/1984 | Bally | 428/300 |
| 4,563,387 | 1/1986 | Takagi | 428/300 |
| 4,594,283 | 6/1986 | Ohigashi | 428/300 |
| 4,603,075 | 7/1986 | Dergarabedean | 428/300 |
| 4,673,616 | 6/1987 | Goodwin | 428/290 |
| 4,944,992 | 7/1990 | Yoneshige et al. | 428/288 |

*Primary Examiner*—James J. Bell

[57] ABSTRACT

A cushion insole/insock material having a compression stiffness, resilience and energy absorption to provide comfort in conventional or sports footware. The material is a non-woven, low density felt made from fibres and imrpegnated with a rubbery impregnant.

24 Claims, No Drawings

CUSHION INSOLE/INSOCK MATERIAL

BACKGROUND OF THE INVENTION

The present invention relates to a novel material for use as a cushion insock or in a cushion insole, which material has compression stiffness, resilience and energy absorption characteristics to provide foot comfort in conventional or sports footwear.

It has been demonstrated in a number of studies, for example as reported by T. A. McMahon and P. R. Greene in J. Biomechanics, 1986, Volume 12, pp 893–904, and by D. J. Pratt, P. H. Rees and C. Rogers, Prosthetics and Orthotics International, 1986, 10, pp 453–45 that compression stiffness and energy absorption characteristics are important in sports shoe design, in particular for designing a good running shoe. Although for a sports shoe the sole unit offers most scope for applying these principles, extra benefit can be derived from the use of an insole or insock having specifically designed compression stiffness and energy absorption characteristics. The use of insocks and insoles having specific compression stiffness and energy absorption characteristics is also desirable in conventional, non-sports footwear, where the sole unit offers less scope for modifying these characteristics.

It has been proposed to provide polymer foam-based insocks and insoles with specific compression stiffness and energy absorption characteristics but these foam-based insocks and insoles have the disadvantages that their moisture-permeability and heat-transmission and moisture-transmission properties are less advantageous than those of conventional non-woven insole and insock materials.

OBJECT OF THE INVENTION

It is an object of the present invention to provide a material for cushion insocks and for use in cushion insoles, in which the above disadvantages are reduced or substantially obviated.

SUMMARY OF THE INVENTION

The present invention provides a material for cushion insoles and insocks comprising a non-woven low-density felt having a thickness of between 3 and 10 mm, said felt being manufactured from fibres and being impregnated with a resilient rubbery impregnant, wherein the fibres have a decitex of between 5 and 17 and a staple length of between 30 and 80 mm, and the density of the impregnated felt is in the order of 0.08 to 0.20 $g/cm^3$(80–200 $kg/m^3$).

One suitable material according to the invention comprises a non-woven felt made from fibres having a decitex of at least 5 decitex, in particular fibres having a decitex of 6.7. In general, it is found that the thickness of fibre which can be used depends upon the required thickness of the finished insock or insole. The thicker the final product, the thicker the fibres to be used. For example, for a felt of a finished thickness of 3 mm, which is considered to be a minimum thickness at which the advantageous properties of the material are obtained, the fibres used should have a thickness of 5 decitex. However, for a felt of 4 mm, the fibres used should have a decitex of at least 6, preferably 6.7. For a felt with a finished thickness of 6 mm, fibres used in the production of the felt are preferably polyester fibres, which may contain up to about 10% by weight of bicomponent fibres, for example bicomponent fibres with a higher melting polyester core and a lower melting polyester sheath. The incorporation of bicomponent fibres in the felt makes the felt suitable for fusion bonding, which increases the extension stability and resilience of the final product.

The felt for use according to the invention is a low-density felt. By the term "low-density" is meant a felt which prior to impregnation has a density of less than 0.1$g/cm^3$(100$kg/m^3$), preferably in the range 0.075 to 0.085$g/cm^3$(75–80$kg/m^3$).

The impregnant used in the material according to the invention may conveniently be a blend of nitrile and PVC latices cross-linked with a cross-linking agent such as melamine-formaldehyde or sulphur; alternatively a polychloroprene latex or polyurethane latex may be used. Cross-linked nitrile/PVC impregnants are preferred, both from cost reasons and because of their heat-sensitivity is more satisfactory. The cross-linked nitrile PVC impregnant is suitably used at a dry impregnant-to-fibre ratio by weight of at least 0.5 to 1.

Where the material according to the invention is to be used as an insole material, it may be necessary to provide it with an integral backing which provides adequate stiffness in, in particular, the forepart of the shoe. Such an integral backing is suitably provided by back coating the impregnated material with a stiffening impregnant such as a styrene/butadiene latex containing approxiatly 60% of styrene. Where back coating is used to provide an integral backing the stiffening impregnant should be chosen to ensure that satisfactory bonding can be obtained during lasting with a hot melt lasting adhesive.

When the material according to the invention is used as an insole material, it is, because of the characteristics which are required from it, rather thicker than conventional insole materials which do not have these characteristics. Depending on the particular style or type of shoe being manufactured, it may be necessary to make slight modifications to conventional shoe-making procedures in order to avoid any difficulties due to this increased thickness. For example in conventional shoe-making techniques the insole is cold-pressed, using a substantial press, to give the forepart some shaping prior to lasting. The insole is then attached to the last, usually with a single insole tack. One problem which may arise if the shoe-making technique is not suitably modified, in particular in the manufacture of ladies' shoes, where the last has a curved bottom, is that during lasting the lasting wipers may catch on the edge of the insole and cause creasing. This problem can be overcome in a number of ways. The preferred way is to press the insole with slight heating, prior to lasting, to give the insole an initial curvature. Alternatively, additional insole tacks may be used to attach the insole to the last, or the edges of the insole may be skived prior to lasting.

For many applications the material according to the invention may be used in a shoe without further surface treatment. In some cases, the slightly fluffy felt-like texture of the insole may be desirable, or the shoemaker may wish, in particular for ladies' shoes where the heel is to be attached by heel nails, to cover the backpart of the insole with an insock to hide the nails so that the surface finish of the insole itself is not important. For applications where a smooth surface is required, the material according to the invention may optionally be provided with a surface finish derived from a fine fibre/bicomponent fibre layer. Such a surface finish is obtained by laying on top of the coarse fibre felt a surface layer comprising a fleece which is a blend of a fine fibre and a fusible fibre, needling the two layers together so that substantially none of the coarser fibres protrude through the surface layer, and heating the material in a heated press to a temperature above the melting point of the fusible fibre. An insole material having such a surface finish is described and claimed in U.S. application Ser. No. 07/513829 filed 24th April 1990 (thus incorporated herein by reference).

It is also possible, by use of an appropriate impregnant, for example an impregnant containing glycerol, to make the material RF (radio frequency) lossy, and thus suitable for cutting and welding using RF techniques. If the fabric and impregnant composition are suitably chosen to allow RF cutting and to provide a surface finish, then this surface finish can be made, during cutting, to extend over the cut edge to provide an edge finish. The provision of an edge finish is particularly desirable in the manufacture of sandal platforms.

Insole or insock materials for use in different type of shoes, for example running shoes or casual shoes, may be required to have different physical properties. It is a feature of the materials according to the present invention that the compression-stiffness, energy-absorption and resilience characteristics can readily be changed by choosing different fibre blends, making base felts of different density, and/or by varying the nature of the impregnant or the binder to fibre ratio at which it is used. For example, an increase in felt weight and density, or an increase in impregnant-to-fibre ratio, will increase the compression-resistance of a particular material.

DESCRIPTION OF THE PREFERRED EMBODIMENTS

Selected materials according to the invention will now be described with reference to the following Examples.

EXAMPLE 1

A base felt was prepared from 100% Hoechst Trevira 290, a polyester staple fibre having a staple length of 60 mm and a density of 6.7 decitex. The base felt is a 450 grams per square meter felt, needled to a gauge of 5.5 mm±0.25 mm.

The felt was impregnated with an impregnant having the following composition:

| | Parts per 100, wet weight |
|---|---|
| Bayer Perbunan Butadiene - Acrylonitrile Latex 2890 (Acrylonitrile content 28%) | 52.0 |
| BASF Lutofan LA951 PVC Copolymer Latex | 2.0 |
| 70% dispersion of EEC International Queensfil 240 Calcium Carbinate Filler | 15.0 |
| BIP Beetle 338 Melamine Formaldehyde Resin | 0.6 |
| Alloid Colloids Viscalex HV30 (Acrylic Copolymer) | 3.1 |
| Bayer Coagulant WS (Organopolysiloxane) | 0.8 |
| DOW Corning DB 110 A Antifoam Emulsion | 0.1 |
| Pigmet | 0.4 |
| Water | 26.0 |
| | 100.0 |

The impregnants had a solids content of approximately 35%.

The felt was impregnated to give a 1:1 dry impregnant-to-fibre ratio, i.e. a pick-up of 450 grams/sq. meter of dry impregnant. The impregnated felt was dried at a temperature rising to 140° C. to provide adequate melamine-formaldehyde cross-linking. The final gauge of the material was 4.5 mm, and the final density 0.17 g/cm (170 kg/m$^3$).

The impregnated felt was then back-coated, to a coating weight of 200 grams per square meter (dry), using a blade or rotary screen coater, using the following formulation:

| | Parts per 100, wet weight |
|---|---|
| Doverstrand Revinex 2023 styrene-butadiene latex, (styrene content 80%) | 73.0 |
| EEC International Speswhite Clay filler (60% solids) | 23.0 |
| Scott Bader Texicryl 13/302 Carboxylated Acrylic Thickening Agent | 4.0 |
| | 100.0 |

The back-coating formulation had a solids content of about 53%. The back-coated material was dried in a hot-air drier.

The material according to this example had a compression modulus of 85 lbs per square inch (0.586 MPa), corresponding to a McMahon-Green "track stiffness" of 20,000 lb per ft (615 kN/m). This material was therefore suitable for use in running shoes.

EXAMPLE 2

For shoes other than running shoes, such as casual or more conventional footwear, a material of lower compression modulus, for example 60 to 70 lbs per squear inch (0.414–0.483 MPa), providing more cushioned comfort may be more suitable.

A material having a compression modulus in the range 60 to 70 lbs per square inch (0.414–083 MPa) was produced by repeating the method of Example 1, using the same felt, impregnant formulation and back-coating method, with the variation that the dry impregnant-to-fibre ratio was reduced to 0.75:1, giving a final density of the 1 impregnated felt of 0.15g/cm$^3$(150kg/m$^3$). The following names referred to in the foregoing are Registered Trade Marks: TREVIRA, PERBUNAN, QUEENSFIL, BEETLE, VISCALEX, REVINEX, TEXICRYL, LUTOFAN, SPESWHITE

We claim:

1. Material for cushion insoles and insocks comprising a non-woven low-density felt having a thickness of between 3 and 10 mm, said felt being manufactured from fibres and being impregnated with a resilient rubbery impregnant, wherein the fibres have a decitex of between 5 and 17 and a staple length of between 30 and 80 mm, and the density of the impregnated felt is in the order of 0.08 to 0.20 g/cm$^3$.

2. Material according to claim 1 wherein the fibres are polyester fibres.

3. Material according to claim 1 wherein the fibres are polyester fibres mixed with bicomponent fibres, the bicomponent fibres constituting not more than 10 percent by weight of the fibre content.

4. Material according to claim 1 having a surface finish derived from a fine fibre/bicomponent fibre layer.

5. Material according to claim 1 wherein the impregnant is a blend of nitrile and PVC latices cross-linked with a cross-linking agent.

6. Material according to claim 1 wherein the impregant is polychloroprene latex.

7. Material according to claim 1 wherein the impregnant is a polyurethane latex.

8. Material according to claim 5 wherein the dry impregnant-to-fibre ratio by weight is at least 0.5:1.

9. Material according to claim 1 wherein the fibres have a decitex of 6.7 and a staple length of 60 mm, the dry impregnant-to-fibre ratio is 1:1, the thickness of the impregnated felt is 4.5 mm and its density 0.17 g/cm$^3$.

10. Material according to claim 9 wherein the dry impregnant-to-fibre ratio is 1:1.

11. Material according to claim 10 wherein the impregnant is polychloroprene latex.

12. Material according to claim 10 wherein the impregnant is a polyurethane latex.

13. Material according to claim 10 wherein the dry impregnant-to-fibre ratio by weight is at least 0.5:1.

14. Material according to claim 10 wherein when used for cushioned insoles, said material is backed with a stiffening impregnant.

15. Material according to claim 14 wherein the stiffening impregnant is a styrene/butadiene latex.

16. Material according to claim 15 having a surface finish derived from a fine fibre/bicomponent fibre layer.

17. Material according to claim 1 wherein the fibres have a decitex of 6.7 and a staple length of 60 mm, the thickness of the impregnated felt is 4.5 mm and its density 0.15 g/cm$^3$.

18. Material according to claim 17 wherein the dry impregnant-to-fibre ratio is 0.75:1.

19. Material according to claim 18 wherein the impregnant is polychloroprene latex.

20. Material according to claim 18 wherein the impregnant is a polyurethane latex.

21. Material according to claim 20 wherein the dry impregnant-to-fibre ratio by weight is at least 0.5:1.

22. Material according to claim 10 wherein when used for cushioned insoles, said material is backed with a stiffening impregnant.

23. Material according to claim 11 wherein the stiffening impregnant is a styrene/butadiene latex.

24. Material according to claim 23 further including a face finish derived from a fine fibre/bicomponent fibre layer.

* * * * *